United States Patent [19]

Chabot

[11] 4,106,144

[45] Aug. 15, 1978

[54] SEA RESCUE CHAMBER AND METHODS OF CONSTRUCTING AND UTILIZING SAME

[76] Inventor: Bernard T. Chabot, 18235 Woodbine, Detroit, Mich. 48219

[21] Appl. No.: 762,849

[22] Filed: Jan. 27, 1977

[51] Int. Cl.[2] ..... B63C 9/06

[52] U.S. Cl. ..... 9/4 R; 114/124

[58] Field of Search ..... 9/14, 4 R, 4 A; 114/124, 141, 77 R, 16.7, 84

[56] References Cited

U.S. PATENT DOCUMENTS

| | | | |
|---|---|---|---|
| 803,174 | 10/1905 | Lake | 114/124 |
| 1,295,893 | 3/1919 | Hartz | 9/4 R X |
| 1,685,719 | 9/1928 | Neill | 9/4 R |
| 1,869,523 | 8/1932 | Strocchi et al. | 9/4 R |
| 2,262,219 | 11/1941 | Armstrong | 9/4 R |
| 2,788,053 | 4/1957 | Dolbey et al. | 114/84 |

*Primary Examiner*—Trygve M. Blix
*Assistant Examiner*—Sherman D. Basinger
*Attorney, Agent, or Firm*—Irving M. Weiner

[57] ABSTRACT

A buoyant sea rescue chamber for use as lifesaving equipment on lake and sea vessels. The chamber includes a substantially enclosed hull portion provided with an adjustable counterweight shaft member adjacent the central portion of the exterior bottom surface of the hull portion. The counterweight shaft permits effective stabilization of the chamber when it is afloat, and two water-sealed entrance doors permit ready access to the chamber by a substantial group of persons during an emergency situation. The chamber is preferably stored during non-use adjacent the cabin section of the lake or sea vessel to provide ready access to the chamber during an emergency situation.

7 Claims, 6 Drawing Figures

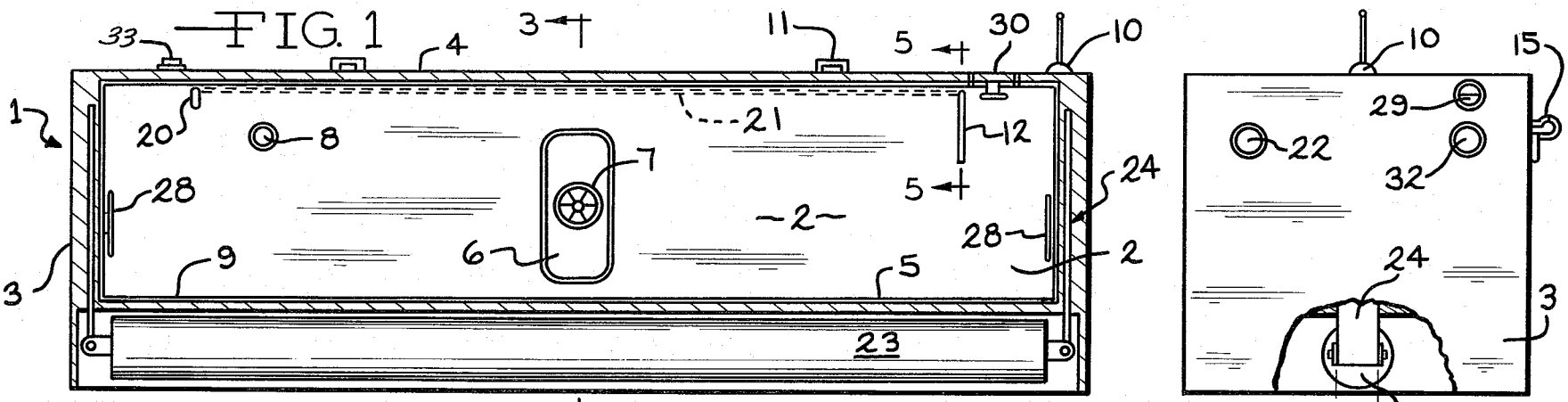
FIG. 1
FIG. 2
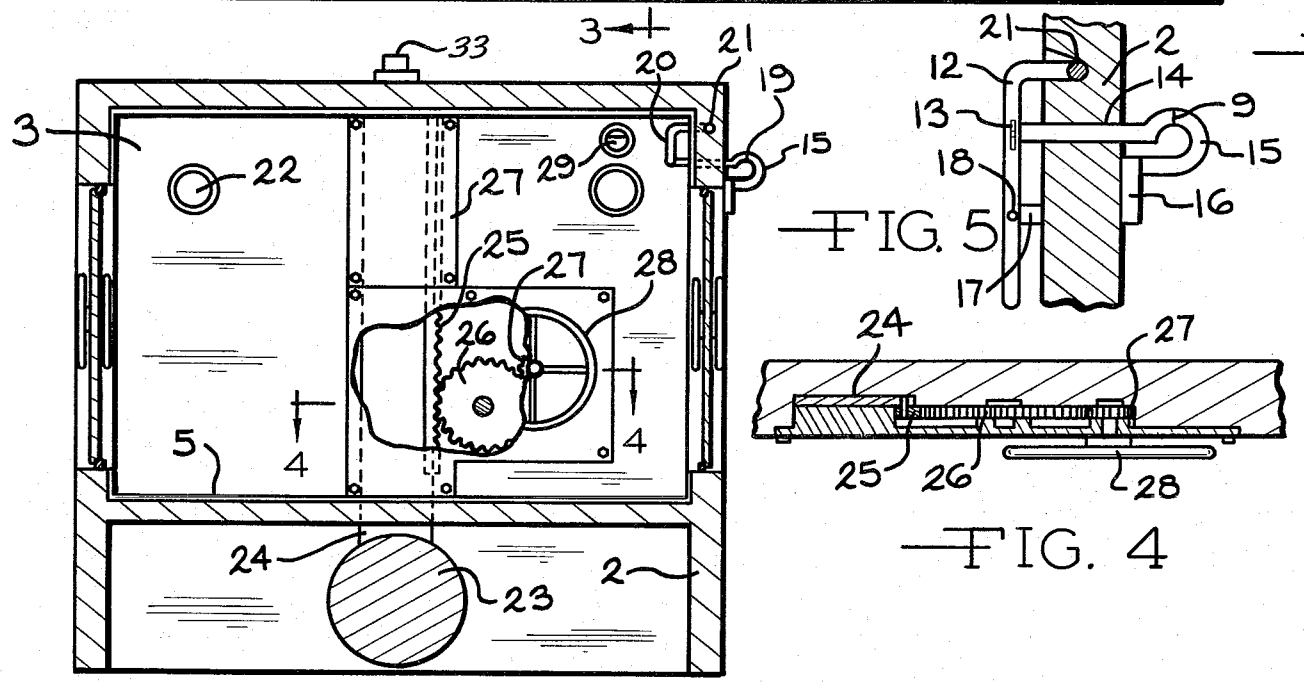
FIG. 3
FIG. 5
FIG. 4
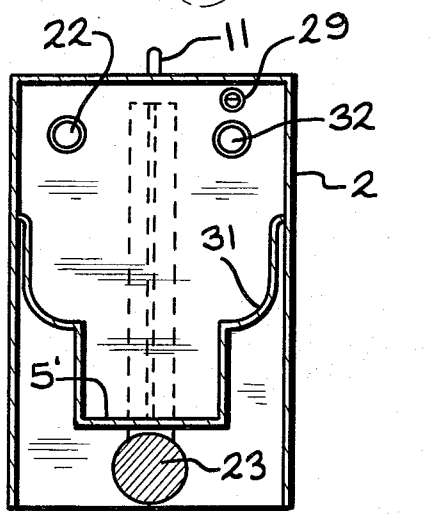
FIG. 6

SEA RESCUE CHAMBER AND METHODS OF CONSTRUCTING AND UTILIZING SAME

BACKGROUND OF THE INVENTION

1. Field of the Invention

The present invention relates generally to a sea rescue chamber which is maintained in a stowed away position at a convenient location on a sea or lake vessel until an emergency situation arises. The chamber is extremely buoyant and stable in rough sea conditions, and includes a substantially enclosed hull portion. The terminology "hull" as used herein is intended to connote the entire main body of the chamber.

In particular, the present invention relates to a sea rescue chamber which is preferably releasably secured to and stored adjacent to the cabin section of a sea or lake vessel to provide ready access to all of the persons onboard the vessel during an emergency ship capsizing situation.

2. Description of the Prior Art

Heretofore, conventional ship survival systems have been woefully and dangerously inadequate in providing safe escape to sailors in the event of the ship's sinking. Indeed, it is a known fact that no sailor has succeeded in escaping a sinking Great Lakes vessel in a storm, and very few, if any, survivors can be expected in a sea vessel sinking incident. Conventionally, ships are provided with a more than adequate supply of standard life rafts and/or life jackets. Problems are encountered, however, in attempting to successfully launch such life rafts during a frantic ship sinking incident, and ofttimes the rafts have a tendency to capsize once launched. Moreover, both standard life rafts and life jackets provide little or no protection from the elements once the occupants thereof are stranded in the open sea, waiting for rescue.

Various prior art attempts have been made in an attempt to solve the foregoing problems. Illustrative of such attempts are the following devices: the "FISH BOAT" disclosed in U.S. Pat. No. 1,619,762 issued in 1927 to Reinhart; the "LIFEBOAT" disclosed in U.S. Pat. No. 2,899,695 issued in 1959 to Nicol; the "SURVIVAL CAPSULE" disclosed in U.S. Pat. No. 3,064,282 issued in 1962 to Kangas; the "LIFE SPHERE" disclosed in U.S. Pat. No. 3,259,926 issued in 1966 to Otterman; the "LIFE RAFT" disclosed in U.S. Pat. No. 3,813,717 issued in 1974 to Mousetis; and the "BOAT CONSTRUCTION" disclosed in U.S. Pat. No. 3,896,515 issued in 1975 to Otterman.

None of the foregoing developments, however, have succeeded in providing a safe, efficient, and conveniently used sea rescue vessel for use with lake and sea vessels. The present invention eliminates the disadvantages and shortcomings attendant these prior art techniques, and at the same time provides a device which eminently fulfills the need for an effective sea rescue device with a minimum of parts and at a reduced cost of manufacture.

SUMMARY OF THE INVENTION

The present invention provides a buoyant sea rescue chamber including a substantially enclosed hull portion. First means are provided for releasably securing the hull portion to a suitable section of a ship in a stored position. At least one watersealed door is disposed in the hull portion and the hull portion is further provided with adjustable counterweight means adjacent an exterior surface thereof for selectively controllably stabilizing the hull portion when it is afloat. Second means are provided for adjusting the relative position of the counterweight means with respect to the exterior surface of the hull portion, and third means are provided for selectively ventilating the hull portion.

In accordance with a preferred embodiment of the present invention, there is provided a hull portion which is releasably secured to the cabin section of a ship, with the interior surface of the hull having disposed thereon and coextensive therewith a layer of insulating material. The hull portion is defined by a substantially horizontal top and bottom wall and substantially vertical side walls, with a rectangular cross section. The counterweight means includes a weighted shaft member disposed adjacent the central portion of the exterior surface of the bottom wall, with the longitudinal axis of the shaft member being substantially parallel to the longitudinal axis of the hull portion. The second means includes retractable support members depending downwardly from opposing side walls of the hull portion and being secured to each end portion of the shaft member. Also, the first means permits the chamber to be released from the cabin section when the hull portion is buoyed upwardly by water contacting the bottom wall.

It is an object of the present invention to provide a novel buoyant sea rescue chamber which is easily accessible in times of emergency ship sinking conditions, and which can be simply and readily released from its stored condition without complicated maneuvering, thus greatly increasing the chances of survival for ship occupants in a ship sinking catastrophe.

It is a further object of the present invention to provide a sea rescue chamber which will protect the occupants thereof from adverse weather and sea conditions until rescue, and which will facilitate recovery operations during severe weather conditions.

Other objects and details of the invention will become apparent from the following description, when read in conjunction with the accompanying drawings.

BRIEF DESCRIPTION OF THE DRAWINGS

FIG. 1 depicts a sectional side elevational view of the chamber in accordance with a first embodiment of the invention.

FIG. 2 illustrates a front elevational view of the embodiment depicted in FIG. 1.

FIG. 3 depicts a view of the chamber taken along line 3—3 of FIG. 1.

FIG. 4 illustrates a view of the gear rack assembly taken along line 4—4 of FIG 3.

FIG. 5 depicts a view of the chamber taken along line 5—5 of FIG. 1.

FIG. 6 illustrates a sectional front elevational view of the chamber in accordance with a second embodiment of the invention.

DETAILED DESCRIPTION OF THE INVENTION

With reference to FIG. 1, there is depicted an interior view of the chamber comprising the main hull portion 1. The hull portion 1 is substantially rectangular in cross section with two elongated opposing side walls 2 and two smaller opposing end side walls 3. A substantially horizontal top wall 4 is also provided and a substantially horizontal bottom wall 5 which serves as the floor. Disposed in each of the elongated side walls 2 is an entrance and exit access door 6. The door 6 is provided with a conventional closure mechanism 7 which permits water-tight sealing of the door 6. Such a mechanism 7 is provided on both the interior surface of the door 6 as shown (FIG. 1) and also on the exterior surface of the door 6 (FIG. 3) to permit opening and closing of the door 6 from both sides.

Also disposed on each of the walls 2 is at least one water-sealed port hole 8 which permits light infiltration therethrough into the interior of the hull portion 1 to prevent claustrophobia from developing in the occupants of the chamber. The port hole 8, for example, may be approximately three inches in diameter. It should be noted that various comfort provisions, although not depicted in FIG. 1, are also contemplated to be provided within the hull portion 1. Such comfort provisions might include, for example, stored food and water, seats, toilet facilities, etc. The entire hull portion 1 is insulated with a layer 9 of suitable material, which might comprise, for example, a 2-inch layer of insulating foam. The layer 9 will serve to insulate the occupants from outside weather and sea conditions, and may have an interior layer of padding coextensive therewith to thus provide a comfortable and safely padded interior for the hull portion 1.

To aid in rescue operations, it is contemplated that the hull portion 1 is further provided with a radio transmitter to permit distress signals to be transmitted to aid in rescue operations. For this purpose, an antenna 10 is disposed adjacent the exterior surface of the top wall 4. Also, to further aid in recovery of the chamber, a pair of hooks 11 are disposed equidistantly from the center of the top wall 4 to enable the entire chamber to be lifted and transported such as by a block and tackle disposed on a recovery vessel or helicopter. The hooks 11 also serve to enable the chamber to be lifted from the sinking vessel by suitable block and tackle and dropped to the water below, if time permits for such an operation to be safely performed. However, because time is of the essence to the occupants of a sinking ship, and captains, engineers, radiomen, etc. must stay at their assigned posts until the last possible minute, the present invention provides an emergency release system which will now be described in detail in connection with FIG. 5.

Secured to the side wall 2 is an L-shaped release member 12 having a slot 13 disposed therein. Adapted to slide in the slot 13 is a small pin connected to the horizontal leg 14 of the hook member 15. The vertical leg 16 of the hook 15 rests slidably against the exterior of the wall 2 as shown. Also, a break line 19 is provided in the hook 15. On the interior surface of the wall 2 is disposed a small horizontal arm 17 which is connected at its outer end to the release member 12 by means of a pull-out safety lock pin 18. As depicted in FIGS. 1 and 3, the entire hook assembly illustrated in FIG. 5 is connected by an elongated rod 21 (FIG. 1) to a similar hook arrangement (FIG. 3) including a hook 15, and a release member 20. In operation, the safety pin 18 is pulled out and a horizontal force is applied by an occupant of the chamber to the lower portion of release member 12 (FIG. 5). The release member 12 will pivot at the slot 13, thus pulling on the horizontal leg 14 which in turn causes the hook 15 to break at the break line 19. This action will be translated to the release member 20 by the rod 21, thus causing the other hook 15 to in turn break at the break line 19.

The hooks 15 are adapted to be received by a suitable receiving mechanism disposed preferably on a side vertical wall of the ship's cabin section. For example, the cabin section may have latches, corresponding hooks, or a horizontal bar, adapted to receive and secure the hooks 15 to the side of the cabin section (not shown). In this manner, when the hooks 15 break at the break lines 19, the hooks 15 will be released from the corresponding receiving mechanism on the cabin section, thus enabling the chamber to be released therefrom for launching. In this connection, the release member 12 can be operated selectively when the occupants of the chamber choose to release the chamber from its stored condition. Alternatively, in the event that the ship is foundering and is partially sinking, and water makes it way to the lower portion of the hull portion 1, thus creating a buoyancy thereof, the chamber will slightly raise due to the buoyance, thus providing a vertical force against the lower portion of the hook 15, and in turn causing the break line 19 to separate. In this manner, the chamber will automatically release itself from its securement to the cabin section when the water reaches a dangerous level. It should be noted that upon breakage of the hook 15 at the break line 19, the portion of hook 15 on the exterior side of break line 19, including the vertical leg 16, will either simply slide down away from the chamber or will dangle from the receiving member disposed on the chamber section (not shown).

Referring back to FIG. 1, the hull portion 1 is further provided with at least one light 33 (which may be a flashing light) adjacent the exterior surface of top wall 4. The light 33 is preferably operated by means of a battery (not shown), and will serve to alert rescue parties in recovery vessels or helicopters as to the location of the stranded rescue chamber, especially during night-time rescue operations.

Also depicted in FIG. 1 is a weighted shaft member 23, the longitudinal axis of which is substantially parallel to the longitudinal axis of the hull portion 1. The shaft 23 is weighted by any desirable heavyweight material so as to be equally weighted along its length. In a stored position, the shaft 23 is held adjacent to the exterior surface of bottom wall 5 by means of the slidable support members 24 which are affixed to each end of the shaft 23. The side walls 3 and elongated side walls 2 of the hull portion 1 extend downwardly below the bottom wall 5 to provide a housing for the shaft 23 as depicted in FIGS. 1, 2 and 3.

With reference now to FIG. 2, there is depicted a front view of the chamber from the exterior of one of the side walls 3. A port hole 22, similar in construction to port hole 8, and an interior battery-operated light 32 is provided in the wall 3 to further aid lighting of the chamber, however, such port hole 22 may be eliminated if desired. The support member 24 is shown in greater detail, and as indicated permits downward translation of the shaft 23. Because the shaft 23 is substantially weighted, selective extension thereof will effectively stabilize the chamber when it is afloat, and will permit the chamber to maintain its upright position without rolling. It should be noted that downward extension of the supports 24 will cause the shaft 23 to ride quite low below the surface of the water, thus lowering the floating level of the chamber and effectively stabilizing the chamber against the action of waves in a rough sea or lake by offering considerable drag to keep the chamber from surfing with the waves.

Referring now to FIG. 3, the operation of the supports 24 are illustrated in detail. The support members 24 each include a vertical rack 25 disposed within a cover plate 27 secured to the interior surface of the wall 3. A gear 26 cooperates with the rack 25 so as to permit slidable extension and retraction thereof when the gear 26 is rotated. For example, when the gear 26 is rotated in a counter-clockwise direction, the support 24 will extend downwardly, and will be retracted when a clockwise rotation of the gear 26 is effected. The gear 26 is rotated by means of a smaller gear 27 with which it also cooperates. The gear 27 is in turn rotated by means of a manually operated wheel 28 (FIGS. 1 and 3). Such a rack and gear assembly for operating the supports 24 is provided in each of the side walls 3 (FIG. 1).

The gear and rack assembly is depicted further in FIG. 4, wherein it can be seen that upon rotation of the wheel 28, a like rotation will be effected in gear 27, with a reverse rotation effected to gear 26, and a resultant up or down sliding motion will be transmitted to rack 25, which in turn effects retraction or extension of support 24 to which it is secured.

It should be noted that the hull portion 1 is preferably of single wall construction and is fabricated of a highly floatable lightweight material, such as fiberglass, or any other desirable lightweight floatable material commonly used in boat construction. The construction of the hull portion 1 is such that it is substantially watertight, and thus is capable of being subjected to tumultuous water conditions without risk of appreciable water seepage. Provided near the upper end of the walls 3 is a vent 29 (approximately two inches in diameter) to permit outside air to enter therethrough, thus providing proper ventilation for the interior of the chamber.

It is highly desirable that the exterior of the hull portion 1, and especially the top wall 4, be painted a bright, highly visible color, to facilitate location and thus retrieval of the chamber from the water. In this manner, the chamber is made far more visible than a conventional life raft would be, thus reducing cost and time involved in locating the chamber in the open sea. Once the chamber has been spotted by a recovery vessel or helicopter, the entire chamber can be retrieved from the water with occupants therein by means of the hooks 11, or if desired individual occupants can be retrieved separately. This is permitted by an escape hatch 30 disposed in top wall 4 (FIG. 1) which is water sealed by suitable closure means when not in use.

With reference now to FIG. 6, an alternate embodiment of the chamber is depicted. In this embodiment, the hull portion is provided with interior sub-walls 31 shaped to form seat portions. The sub-walls 31 curve upwardly to engage the elongated side walls 2, and at the lower portion thereof form the horizontal bottom wall 5'. It can be seen that in this embodiment water will be permitted to enter the empty space defined by the sub-walls 31, the bottom wall 5' and the side walls. It is contemplated that this construction will thus provide a lower float level of the chamber as a whole, and again an effective stabilizing of the chamber, enhanced by selective extension of the shaft 23, is achieved.

From the foregoing, it can be seen that because the chamber is normally stowed in a highly accessible position, i.e., adjacent the cabin section of a ship, access thereto during times of stress is greatly increased. Also, because it is contemplated that at least one door 6 is provided in each of the elongated side walls 2, it is possible to admit a large group of people into the chamber in a relatively short period of time. Thus, the sea rescue chamber in accordance with the present invention provides a safe and efficient survival unit which permits swift loading of occupants and which provides safe and comfortable conditions even in the most turbulent of sea and weather conditions, until rescue operations are effected. The size of the chamber can be varied to accommodate a desired number of occupants, such as a 25-man size, or a 50-man size, for example, and would effectively replace existing conventional life saving equipment currently found on ships with a lifesaving unit which will prove far more effective in preventing fatalities in a ship-sinking incident.

Although there have been described what are at present considered to be the preferred embodiments of the invention, it will be understood that various modifications may be made therein, and it is intended to cover in the appended claims all such modifications as fall within the true spirit and scope of the invention.

I claim:

1. A buoyant sea rescue chamber comprising:

a substantially enclosed hull portion;

first means for releasably securing said hull portion to a suitable section of a ship to secure said hull portion in a stored position;

at least one water-sealed door disposed in said hull portion;

said hull portion being provided with adjustable counterweight means adjacent an exterior surface thereof for selectively controllably stabilizing said hull portion when it is afloat;

second means for adjusting the relative position of said counterweight means with respect to said exterior surface of said hull portion;

third means for selectively ventilating said hull portion;

said hull portion being adapted to be releasably secured to the cabin section of a ship;

said hull portion having disposed coextensive with the interior surface thereof a layer of insulating material;

said hull portion being defined by a substantially horizontal top wall and bottom wall and substantially vertical side walls;

said counterweight means comprising a weighted shaft member;

said weighted shaft member being adjustably disposed adjacent the exterior surface of said bottom wall;

said second means comprising retractable support members depending downwardly from said hull portion and being secured to said shaft member;

said hull portion having a substantially rectangular cross section;

two of said retractable support members being provided, each of said support members being secured to an end portion of said weighted shaft member;

said two support members depending downwardly from opposite side walls of said hull portion; and said first means permitting said chamber to be released from said cabin section when said hull portion is buoyed upwardly by water contacting said bottom wall.

2. A buoyant sea rescue chamber in accordance with claim 1, wherein:

said top wall of said hull portion has disposed on the exterior surface thereof at least one hook member to permit selective lifting and transporting of said chamber by suitable hoist means; and at least two of said side walls are each provided with one of said water-sealed doors.

3. A buoyant sea rescue chamber in accordance with claim 1, wherein:

said side walls extend downwardly below said bottom wall to provide a housing for said weighted shaft member;

the longitudinal axis of said weighted shaft member is substantially parallel to the longitudinal axis of said hull portion; and said weighted shaft member is disposed adjacent the central portion of said exterior surface of said bottom wall.

4. A buoyant sea rescue chamber in accordance with claim 1, wherein:

a hatch provided with a water-tight hatch cover is disposed in said top wall; and said first means comprises a plurality of manually operable hook members disposed on one of said side walls and corresponding hook receiving members disposed on said cabin section.

5. A buoyant sea rescue chamber in accordance with claim 1, wherein:

said third means comprises a plurality of air vents disposed in said side walls;

a plurality of water sealed port holes are disposed proximal the upper portions of said side walls to permit light infiltration; and each of said support members is provided with a corresponding gear and rack assembly disposed in said opposite side walls to permit selective retraction and extension of said support members.

6. A buoyant sea rescue chamber in accordance with claim 1, wherein:

the exterior surface of said top wall is provided with at least one light, said light being operated by suitable battery means;

the interior surface of said top wall is provided with at least one light, said light being operated by suitable battery means;

said chamber is provided with radio transmission means; and said water sealed door is adapted to be opened from both the interior and exterior of said hull portion.

7. A buoyant sea rescue chamber in accordance with claim 1, wherein:

at least two opposite side walls of said hull portion are provided with interior sub-walls;

said sub-walls being adapted to form seat portions; and said sub-walls being connected at their upper ends to said two opposite side walls and at their lower ends to said bottom wall.

* * * * *